United States Patent [19]

Friedrich

[11] 4,444,815

[45] Apr. 24, 1984

[54] WATER PERMEABLE GROUND COVERING FOR OPEN SPACES

[75] Inventor: Hans-Joachim Friedrich, Auenwald, Fed. Rep. of Germany

[73] Assignee: J. F. Adolff AG, Backnang, Fed. Rep. of Germany

[21] Appl. No.: 502,045

[22] Filed: Jun. 7, 1983

Related U.S. Application Data

[63] Continuation of Ser. No. 367,519, Apr. 12, 1982, abandoned.

[30] Foreign Application Priority Data

Apr. 23, 1981 [DE] Fed. Rep. of Germany ..... 3116231

[51] Int. Cl.[3] ..... B32B 3/02

[52] U.S. Cl. ..... 428/17; 428/95

[58] Field of Search ..... 428/17, 95

[56] References Cited

U.S. PATENT DOCUMENTS

| | | | |
|---|---|---|---|
| 2,054,517 | 9/1936 | Teaque | 428/17 |
| 3,157,557 | 11/1964 | Palmer | 428/17 |
| 3,740,303 | 6/1973 | Alderson | 428/17 |
| 3,995,079 | 11/1976 | Haas | 428/17 |
| 4,044,179 | 8/1977 | Haas | 428/17 |

OTHER PUBLICATIONS

Japanese Unexamined Utility Model Publication No. 48-25525, Mar. 27, 1973, Fukuda.

*Primary Examiner*—Marion McCamish

*Attorney, Agent, or Firm*—Neuman, Williams, Anderson & Olson

[57] ABSTRACT

The invention relates to a ground covering for open spaces, with which a water-permeable filter mat impervious to granular material is bonded to the underside of a water-permeable artificial grass so that a filling of granular material in the pile of the grass will not be swept away to the edges of the surface covered by the ground covering even in heavy rain since the water may drain immediately through the artificial grass and the filter mat to the underside of the ground covering.

6 Claims, 1 Drawing Figure

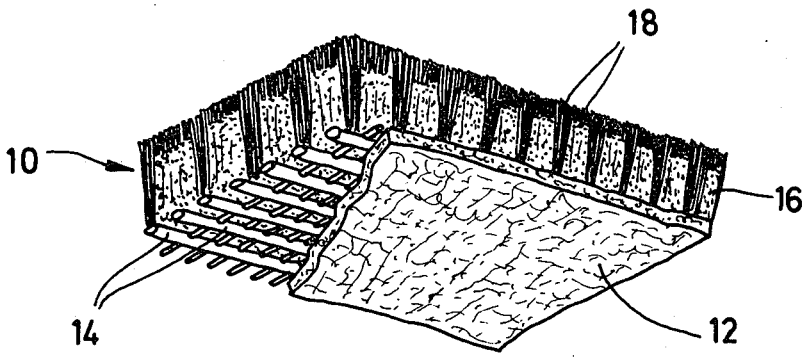
18
10
16
14
12

WATER PERMEABLE GROUND COVERING FOR OPEN SPACES

This is a continuation of application Ser. No. 367,519 filed Apr. 12, 1982, now abandoned, the text of which is hereby incorporated by reference.

The invention relates to a ground covering for open spaces, especially for sports and playing area, comprising an artificial grass as surface layer and a filling of granular material, in particular sand, between the pile threads of the grass, the free ends of the pile threads protruding upwards above the filling.

A known ground covering of this type uses synthetic or artificial grass of approx. 20 mm in depth and with a water-impermeable back, which is produced such that a tufted grass material is provided on its underside with a continuous, rubber-like layer. This artificial grass is then provided from above with a filling of granular material, a material on a silicon basis with additives.

A disadvantage of the known ground covering is that due to the water-impermeable coating on the back of the artificial grass rainwater and the like may only be drained off along the edge of the ground covering, the danger then being that the granular material of the filling will be washed out of the grass pile during heavy rain, for example a thunder shower, so that the ground covering will no longer have the desired, even surface quality, especially since the pile threads of the grass will be too long once the filling has been washed away.

Proceeding on the basis of the prior art and the problems noted above the object underlying the invention is to provide an improved ground covering of the type mentioned at the beginning, with which the danger of the filling of granular material being washed away is reduced to a minimum.

This object is solved according to the invention for a ground covering of the type described at the beginning in that the artificial grass is a water-permeable, artificial grass and that a water-permeable filter mat impervious to the granular material is bonded to the back of this grass.

The decisive advantage of this ground covering according to the invention over the known ground covering is that melted snow and ice and rainwater, even in considerable quantities, may drain away through the artificial grass and the filter mat to the underside of the ground covering and there into the ground or the drainage system provided; the filler material between the pile threads of the grass is thus prevented from being washed away to the edges. At the same time the filter mat also prevents material from the ground passing up through the drainage openings of the artificial grass into the pile of the grass.

It has proven favourable for the water-permeable, artificial grass to be raschel knitted grass with coated ribs provided on its underside since a good permeability may be achieved with this type of artificial grass. In this connection it is particularly favourable that the ribs, which protrude beyond the adjacent areas, may also be well bonded to the filter mat, in particular by thermal heat-sealing.

It is also an advantage to use a water-permeable, artificial grass which is provided on its back with knops of elastic material; these knops again ensure a good permeability and are also available as protruding points or areas, onto which the filter mat may be bonded, this filter mat preferably being constructed as a fleece or felt mat.

Additional details and advantages of the invention will be explained in detail in the following on the basis of the drawing, the single FIGURE showing a schematic, perspective representation of a preferred embodiment of a ground covering according to the invention, seenfrom below in three-quarter view.

The drawing shows in detail a section of an artificial grass 10, a filter mat 12 being bonded to its underside. The filter mat 12 is bonded to the grass 10 in such a way that of the grid-like webs or ribs 14 of the backing for the grass at least those ribs placed parallel to each other in one direction—in the embodiment the ribs shown in the drawing as running from left to right—are provided with a coating which allows the filter mat 12 to be bonded to the artificial grass, preferably by thermal heat-sealing. The coating of the ribs 14 need not, however, consist of a thermoplastic material but may also, for example, consist of an age-hardening plastic which is first of all applied in a tacky state and with which the filter mat 12 is then bonded or glued.

The artificial grass 10 has pile threads 18 protruding upwards from the grid-like backing; these pile threads are often formed, in practice, of narrow plastic strips, especially when raschel knitted material is used for the grass 10, and, according to the invention, are longer than is usually the case for artificial grass, for example have a length of approx. 20 mm.

When the water-permeable artificial grass 10 with the permanently bonded filter mat is laid on the prepared ground, which is preferably water-permeable as well or provided with a drainage system, a granular filler material, especially sand, is deposited on the upper side of the grass 10 to complete the ground covering according to the invention and spread such that an even layer of granular material or layer of sand 16 results. The depth of this layer may be selected such that the free ends of the pile threads 18 protrude above the surface of the sand layer 16, for example by about 5 mm. This type of ground covering has proven excellent, for example, for tennis courts since the fact that the ground covering has a good tread elasticity will also mean that the balls will have a precise bounce which is valued by tennis players. On the other hand, there is no longer any danger with the ground covering according to the invention, unlike the ground coverings of this type previously used, that the filler material will be washed away to the edges of the playing area and out of the pile of the artificial grass to any considerable extent by heavy rain or melted snow and ice. In this way a considerable improvement in the stability of the ground covering may be achieved in respect of the draining of surface water with very slight additional costs and efforts—it is merely a matter of providing the filter mat or exchanging the mat previously provided to improve tread elasticity for a suitable filter mat.

Finally, it is pointed out that a tufted grass on a water-permeable backing may be used as water-permeable grass, the ribs formed by the tufting on the underside of the backing being provided with a coating.

I claim:

1. A ground covering for open areas, and particularly adapted for use as a covering for sports and play areas, comprising a layer of artificial grass, having an underside, an upper surface of pile threads and a filling of granular material such as sand or the like disposed between said threads; the free ends of said pile threads projecting above said granular material in the normal position of covering use; said layer of artificial grass in said ground covering being water permeable and also comprising a gridlike web carrying said pile threads at its upper surface and defining open spaces for draining water reaching said upper surface therethrough; said web also having projections on its underside; bonding means at least partially coating said projections, and a filter mat formed of fleece or felt bonded to said coated projections by said bonding means; said filter mat having passageways through the thickness thereof for permitting ready passage of water therethrough; said filter mat preventing passage of said granular material of the artificial grass layer whereby said ground covering is water permeable and said granular material is retained by the filter mat.

2. A ground covering for open areas, and particularly adapted for use as a covering for sports and play areas, comprising a layer of artificial grass, having an underside, an upper surface of pile threads and a filling of granular material such as sand or the like disposed between said threads; the free ends of said pile threads projecting above said granular material in the normal position of covering use; said layer of artificial grass in said ground covering being water permeable and also comprising a gridlike web carrying said pile threads at its upper surface and defining open spaces for draining water reaching said upper surface therethrough; said web also having projections on its underside; bonding means at least partially coating said projections, and barrier means bonded to said coated projections for simultaneously permitting drainage of water from said covering to the underlying ground, preventing material from the ground covered by said covering from passing from such ground into the open spaces of said web, and preventing passage of said granular material of said artificial grass from said ground covering.

3. The ground covering as claimed in claim 1 or 2, wherein said water permeable layer of artificial grass is a raschel knitted grass layer and wherein said coated projections are coated ribs at the underside of said water permeable layer.

4. The ground covering as claimed in claim 1 or 2 wherein the coated projections comprise knobs of an elastic bonding agent.

5. The ground covering as claimed in claim 1 or 2, wherein said water-permeable layer of artificial grass has a tufted pile extending from a water-permeable woven base.

6. The ground covering of claim 2 in which said barrier means is a filter mat formed of fleece or felt.

* * * * *